United States Patent [19]

Kratel et al.

[11] Patent Number: 4,636,416

[45] Date of Patent: Jan. 13, 1987

[54] SHAPED MICROPOROUS THERMAL INSULATION BODY WITH SHEATHING AND PROCESS FOR MAKING SAME

[75] Inventors: Günter Kratel; Günter Stohr, both of Durach-Bechen; Franz Schreiner, Sulzberg, all of Fed. Rep. of Germany

[73] Assignee: Wacker-Chemie GmbH, Munich, Fed. Rep. of Germany

[21] Appl. No.: 734,034

[22] Filed: May 14, 1985

[30] Foreign Application Priority Data

May 18, 1984 [DE] Fed. Rep. of Germany ..... 3418637

[51] Int. Cl.[4] ..... B32B 1/00; B32B 3/00; B32B 3/26

[52] U.S. Cl. ..... 428/69; 156/77; 156/286; 156/303.1; 428/76; 428/315.9

[58] Field of Search ..... 156/77, 285, 286, 287, 156/303.1; 428/68, 69, 76, 315.5, 315.7, 315.9

[56] References Cited

U.S. PATENT DOCUMENTS

| | | | |
|---|---|---|---|
| 2,012,617 | 8/1935 | Munters | 428/314.4 |
| 2,067,015 | 1/1937 | Munters | 428/69 |
| 4,269,323 | 5/1981 | Ito et al. | 428/69 |
| 4,304,824 | 12/1981 | Karpinski | 428/69 |
| 4,359,496 | 11/1982 | Kratel et al. | 428/75 |
| 4,399,175 | 8/1983 | Kummermehr et al. | 428/76 |
| 4,444,821 | 4/1984 | Young et al. | 428/69 |
| 4,447,345 | 5/1984 | Kummermehr et al. | 428/76 |

FOREIGN PATENT DOCUMENTS

| | | |
|---|---|---|
| 0047494 | 3/1982 | European Pat. Off. . |
| 2443390 | 3/1976 | Fed. Rep. of Germany . |
| 732594 | 6/1932 | France . |
| 2321025 | 3/1977 | France . |
| 165445 | 12/1980 | Japan . |

OTHER PUBLICATIONS

*Chemical Abstracts* vol. 94, 1981, p. 206, Abstract No. 106620h, Nissan Motor Co., "Insulation of Heat Storage".

*Primary Examiner*—William J. Van Balen
*Attorney, Agent, or Firm*—Collard, Roe & Galgano

[57] ABSTRACT

A molded thermal insulation body having a microporous thermal insulation material encased in a sheathing. The molded body is partially evacuated to a partial air pressure of 20 mbar or less. Following the evacuation of air, the molded body may be filled with krypton, xenon, sulfur hexafluoride, carbon dioxide or a combination thereof. A process for the manufacture of the molded thermal insulation body is also provided.

16 Claims, 1 Drawing Figure

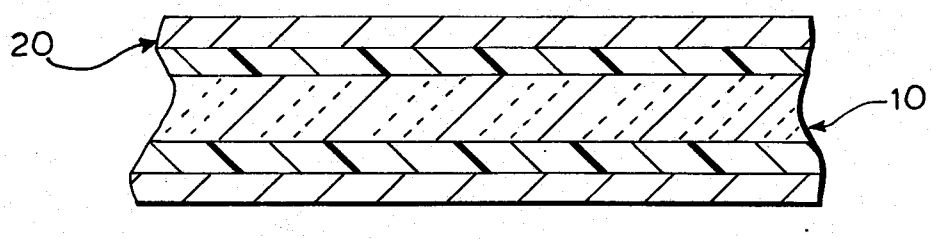
20
10

SHAPED MICROPOROUS THERMAL INSULATION BODY WITH SHEATHING AND PROCESS FOR MAKING SAME

The present invention relates to a thermal insulation body having molded, microporous thermal insulation material with a sheathing and a process for its manufacture.

Shaped thermal insulation bodies utilizing molded, microporous thermal insulation material are known, e.g., from German Offenlegungsschrift, DE-OS No. 30 33 515 and which corresponds to U.S. Pat. No. 4,359,496. Furthermore, it is known how to partially or completely sheath such shaped bodies, e.g., with glass fiber fabrics, aluminum foil or other coating materials. Such shaped thermal insulation bodies exhibit excellent insulation properties especially at high temperatures, particularly, at temperatures ranging from about 200° C. to 1,000° C. However, at temperatures ranging from about −50° C. to 200° C., the insulation properties of such materials are only comparable to those of other insulation materials having less efficiency or suitability at higher temperatures.

Consequently, very thick layers of microporous insulation material are required if an insulation is to be designed so that when utilized as an insulation against high temperatures, the cooler side of such insulation layer will have temperatures ranging only from about −10° C. to 40° C.

Recently, tests have shown that the insulation efficiency of evacuated packings of microporous material or the insulation efficiency of packings of microporous material filled, e.g., with xenon, is greater than the insulation efficiency of air-filled packings.

Accordingly, it is an object of the present invention to enhance the thermal insulation efficiency of a shaped thermal insulation body utilizing a molded, microporous thermal insulation material at temperatures ranging from approximately −50° C. to 200° C.

It is also an object to provide a method for the manufacture of the thermal insulation body of the present invention.

The foregoing and related objects are readily attained by a shaped body composed of a molded, microporous material which is evacuated. Alternatively, the molded bodies may be filled with gases other than air, e.g., krypton, xenon, sulfur hexafluoride or carbon dioxide. Surprisingly, the increase in insulation efficiency resulting from evacuating the molded bodies is sufficient to justify the increased construction costs, although, of course, the air content of these pressed shaped bodies is greatly reduced, as compared to packings, due to the molding or pressing step.

The manufacture of the present invention is accomplished by pre-compacting and then molding a microporous thermal insulation under pressure while allowing gases present in the packings of the insulation material to escape. The molded body is then provided with a sheathing and evacuated to a partial air pressure of 20 mbar or less. The molded body may then be filled with krypton, sulfur hexafluoride, xenon, carbon dioxide or a combination thereof, prior to sealing the sheathing making it airtight.

Other objects and features of the present invention will become apparent from the following detailed description when taken in connection with the accompanying drawing which discloses several embodiments of the invention. It is to be understood that the drawing is designed for the purpose of illustration only and is not intended as a definition of the limits of the invention.

In the drawing, a cross sectional view of a thermal insulation body, embodying the present invention, is shown.

Turning now in detail to the appended drawing, therein illustrated is a novel thermal insulation board 1, embodying the present invention which basically includes a molded, microporous thermal insulation material 10 provided with a sheathing 20. The partial pressure of the air within the sheathed thermal insulation board is 20 mbar or less.

If desired, the thermal insulation boards, according to the present invention, may be filled with krypton, xenon, sulfur hexafluoride or carbon dioxide. The partial pressure of these gases may range from 0 to 1000 mbar, preferably, from 0 to 400 mbar.

Finely particulate metal oxides are used as the microporous thermal insulation material. The following compositions for thermal insulation were found to be typical of those compositions that produced good results:

30–100% by weight finely divided metal oxide;
0–30% by weight opacifier;
0–20% by weight fiber material; and
0–15% by weight inorganic binder.

Preferably, the proportion of binder is from 0.3 to 1.5% by weight.

Examples of finely particulate metal oxide include, e.g., pyrogenically produced silicic acids including arc-silicic acids, precipitated silicic acids with low alkali content and analogously produced aluminum oxide, titanium dioxide and zirconium dioxide. The finely divided metal oxides have specific surface areas of 50 to 700 sq.m./g and, preferably, from 70 to 400 sq.m./g.

Suitable opacifiers include, e.g., ilmenite, titanium dioxide, silicon carbide, iron-II-iron-III mixed oxide, chromium dioxide, zirconium oxide, manganese dioxide, as well as iron oxide. Advantageously, the opacifiers have an absorption maximum in the infrared range of from 1.5 to 10 μm.

Examples of the fiber material are, e.g., glass wool, stone wool, slag wool, ceramic fibers as produced from melts of aluminum oxide and/or silicon oxide, as well as asbestos fibers and others.

The inorganic binder includes, by way of example, the borides of aluminum, titanium, zirconium, calcium, and the silicides such as calcium silicide and calcium-aluminum silicide and, in particular, boron carbide. Examples of other components are, e.g., basic oxides, in particular, magnesium oxide, calcium oxide and barium oxide.

The thermal insulation body according to the present invention generally has a flat shape. In special cases, however, the present invention may have the shape of circular segments and the like. The thermal bodies may also include, e.g., bevelled edges, folds, etc.

According to the present invention, the thermal insulation board is based upon the use of a microporous material provided with a gastight sheathing. The requirement that the sheathing has to meet with respect to its resistance to pressure is relatively low since the sheathing is in direct contact with, and supported by, the molded body so that the pressure of the ambient atmosphere is absorbed.

Examples of the sheathing material include, e.g., composite foil materials with the following layer sequence: thermoplastic material/metal foil/thermoplastic material. In special cases, such a composite foil has the following layer sequence: polypropylene/aluminum foil/polyester. Other examples include composite foils with the layer sequence polyfluorohydrocarbon/polyimide, which, if need be, may also have a layer of aluminum foil. Preferably, in order to permit a favorable manufacture of the thermal insulation body, the sheathing is comprised of two separate layers, namely, a first layer of a thermoplastic material, e.g., polyethylene, and a second layer which may include one of the above composite foil materials.

It is also possible, e.g., that glass plates combined with each other by using gastight sealing compounds which may serve as the sheathing. Suitable sealing compounds include, e.g., polymers and copolymers of hexafluoropropylene, vinylidene fluoride and the like.

For producing the thermal insulation body according to the present invention, the shaped bodies are prefabricated by currently known methods. Preferably, the manufacturing process comprises the following steps:

(a) Precompacting the thermal insulation mixture based upon a microporous insulation material at pressures in the range of 1 to 5 bar and, preferably, at pressures of about 2 bar;

(b) Molding the precompacted material into a final mold at pressures ranging from 10 to 15 bar. In this step, the density of the microporous insulation material is increased approximately 5 to 10 times as compared to the bulk weight of the microporous material; and (c) If necessary, heating the pressed body at temperatures from 500° C. to 800° C.

In either the precompacting or molding steps, the gases trapped in the packing should be able to escape. Therefore, the compression and pressing or molding is preferably carried out at pressures below one atmosphere. However, degassing (i.e., permitting the trapped gases to escape) may also take place prior to the compression or molding steps.

Subsequent to the above series of steps, the prefabricated molded body is provided with a sheathing and then evacuated until its partial air pressure is 20 mbar or less. Typically, evacuation is carried out until the partial air pressure of the molded body is between 20 mbar and $10^{-4}$ mbar. If desired, the evacuated system may then be filled with gases such as krypton, xenon, sulfur hexafluoride, carbon dioxide or a mixture thereof. Finally, the sheathing is sealed airtight. Such sealing can be achieved, e.g., by fusing the above composite foil materials.

The thermal insulation board according to the invention is particularly useful for insulation in temperatures ranging from −50° C. to 200° C., for example, as insulation material in refrigerated areas. In addition, the invention may serve as an additional element for thermal insulations in regenerative furnaces and the like, where, preferably, it is used in combination with non-evacuated high temperature insulations based upon microporous thermal insulation material. In such cases, the non-evacuated thermal insulation layer is designed so that a decrease in temperature to approximately 100° C. to 200° C. occurs, whereby the evacuated thermal insulation body, according to the invention, has a temperature in the range of the ambient temperature.

By using the inventive thermal insulation board, highly efficient insulation arrangements are possible with layer thicknesses which may be substantially reduced when compared to conventional insulation arrangements having a comparable insulation effect. The thermal insulation body is installed in the same way as conventional thermal insulation boards.

In the following example, the inventive thermal insulation body and its manufacture will be more fully described. However, it should be noted, that the Example is given only by way of illustration and not of limitation.

EXAMPLE

A board (size 300 ×300 mm) having a thickness of 20 mm was molded by pressing a thermal insulation mixture composed of:

60% by weight highly dispersed silicic acid;
34.5% by weight ilmenite;
5% by weight aluminum silicate fiber; and
0.5% by weight boron carbide;

at 10 kg/cm$^2$ pressure.

The board was then sheathed with a composite foil (polypropylene/aluminum/polyester) of 100 μm thickness and evacuated to a residual pressure of 20 mbar.

The heat-transfer coefficient λ of the board at 100° C. came to $$0.012 \frac{W}{K \times m}.$$

For comparison purposes, a heat-transfer coefficient $$\lambda = 0.022 \frac{W}{K \times m}$$

was measured for a non-evacuated board.

The thermal insulation efficiency of the inventive body was therefore increased by 46%.

While only one embodiment and example of the present invention have been shown and described, it is obvious that many changes and modifications may be made thereunto, without departing from the spirit and scope of the invention.

What is claimed is:

1. A thermal insulation body for use at temperatures ranging from approximately −50 to 200° C., comprising:

a pressed microporous thermal insulation material encased in a sheathing and evacuated to a partial air pressure of 20 mbar or less.

2. The thermal insulation body according to claim 1, wherein the partial air pressure of said pressed microporous insulation material is between 20–$10^{-4}$ mbar.

3. The thermal insulation body according to claim 1, wherein said pressed microporous insulation material is filled with a gas selected from the group consisting of krypton, xenon, sulfur hexafluoride, carbon dioxide and a combination thereof.

4. The thermal insulation body according to claim 3, wherein the partial pressure of the gas filling said microporous material is from 0 to 400 mbar.

5. The thermal insulation body according to claim 1, wherein said sheathing material is a composite foil including at least one metallic layer and a layer of a thermoplastic polymer material.

6. The thermal insulation body according to claim 1, wherein said microporous thermal insulation material is:

30–100% by weight of at least one finely particulate metal oxide;
0–30% by weight an opacifier;
0–20% by weight a fiber material; and
0–15% by weight an inorganic binder.

7. The thermal insulation body according to claim 6, wherein said finely particulate metal oxide has a specific surface area of from 70 to 400 $m^2/g$.

8. The thermal insulation body according to claim 6, wherein said opacifier has an absorption maximum in the infrared range of from 1.5 to 10 $\mu m$.

9. The thermal insulation body according to claim 6, wherein said inorganic binder is a member selected from the group consisting of boron carbide, magnesium oxide, calcium oxide and barium oxide.

10. The thermal insulation body according to claim 6, wherein said inorganic binder is 0.3 to 1.5% by weight of said microporous thermal insulation material.

11. The thermal insulation body according to claim 1, wherein said sheathing has a first layer of thermoplastic material and second composite foil layer with the layer sequence thermoplastic material/metal foil/thermoplastic material.

12. The thermal insulation body according to claim 11, wherein said first layer of thermoplastic material is polyethylene.

13. A process for the manufacture of a thermal insulation body for use at temperatures ranging from approximately −50 to 200° C., comprising the steps of:

(a) precompacting a microporous thermal insulation material, having packings, at a pressure in the range of 1 to 5 bar;
(b) molding said pre-compacted material at a pressure in the range of 10 to 15 bar into a molded body;
(c) allowing the gases trapped in said molded body to escape;
(d) encasing said molded body with a sheathing;
(e) evacuating said molded body to a partial air pressure of approximately 20 mbar or less; and
(f) sealing said sheathing thereby making it airtight.

14. The process according to claim 13, further comprising the step of heating said molded body at a temperature between 500° C. to 800° C., following step (b).

15. The process according to claim 13, further comprising the step of filling said molded body with a gas selected from the group consisting of krypton, xenon, sulfur hexafluoride, carbon dioxide and a combination thereof, following step (e).

16. The process according to claim 13, wherein steps (a) and (b) are performed at a pressure below one atmosphere.

* * * * *